US007128691B2

(12) United States Patent
Cottrell

(10) Patent No.: US 7,128,691 B2
(45) Date of Patent: Oct. 31, 2006

(54) HIP HOP AEROBIC EXERCISE DOLL

(76) Inventor: Robin E. Cottrell, 7322 S. Wolcott Ave., Chicago, IL (US) 60636

( * ) Notice: Subject to any disclaimer, the term of this patent is extended or adjusted under 35 U.S.C. 154(b) by 0 days.

(21) Appl. No.: 11/099,797

(22) Filed: Apr. 6, 2005

(65) Prior Publication Data

US 2005/0221966 A1 Oct. 6, 2005

Related U.S. Application Data

(60) Provisional application No. 60/559,752, filed on Apr. 6, 2004.

(51) Int. Cl.
*A63B 21/00* (2006.01)

(52) U.S. Cl. ..... 482/3; 482/1; 482/8; 482/9; 482/901

(58) Field of Classification Search ..... 482/1–9, 482/900–902; 434/169, 247, 250, 256; 463/46; 446/268, 297–303

See application file for complete search history.

(56) References Cited

U.S. PATENT DOCUMENTS 6,159,101 A * 12/2000 Simpson ..... 463/46
6,227,931 B1 * 5/2001 Shackelford ..... 446/268
6,494,762 B1 * 12/2002 Bushmitch et al. ..... 446/268
6,517,351 B1 * 2/2003 Spector ..... 434/169
6,863,587 B1 * 3/2005 Bennett ..... 446/297

* cited by examiner

*Primary Examiner*—Glenn E. Richman
(74) *Attorney, Agent, or Firm*—James Ray & Assoc.

(57) ABSTRACT

An aerobic exercise system for encouraging a person to exercise more which includes a doll having movable extremities which at least include arms and legs which are capable of moving in a predetermined aerobic manner. An aerobic video displays predetermined movements to be performed by the doll. There is a chip disposed within such doll which is connected to the arms and legs for causing predetermined aerobic movements of the doll which correspond to movements of the aerobic video. Additionally, there is at least one aerobic type bench for the doll to perform such predetermined aerobic exercises on.

4 Claims, 1 Drawing Sheet

HIP HOP AEROBIC EXERCISE DOLL

CROSS REFERENCE TO RELATED APPLICATIONS

This patent application is related to and claims priority from U.S. Provisional Patent Application Ser. No. 60/559,752 Filed on Apr. 6, 2004, titled "HIP HOP AEROBICS DOLLS".

FIELD OF THE INVENTION

The present invention relates, in general, aerobic exercising and dolls and, more particularly, this invention relates to an aerobic type exercise doll and, still more particularly, the instant invention relates to an aerobic type exercise doll which can be timed to do aerobic moves which will correspond to at least one of a video and aerobic exercise music supplied with such aerobic type exercise doll.

BACKGROUND OF THE INVENTION

In the United States and certain other parts of the world it is known that there are numerous overweight children today. This is especially the case where food is plentiful. It is even more the situation where sweets are available in great supply. It is believed that this is also caused in great part by children today watching too much television and not getting a normal amount of exercise. In other words, children today are becoming couch potatoes who eat far too many fattening type foods which are especially high in carbohydrates.

It can be seen from this discussion that there is a need for a some relatively inexpensive means to motivate children as well as adults to exercise more in order to promote a more healthy body.

Prior to the conception and development of the present invention, as is also generally well recognized in the prior art, exercise machines and toys have been taught in the prior art. See, for example, U.S. Pat. No. 4,948,124.

SUMMARY OF THE INVENTION

The present invention provides a hip hop aerobic exercise system for encouraging children and adults to exercise more.

In a first embodiment, such hip hop aerobic exercise system includes an aerobic doll having movable extremities. Such moveable extremities of the aerobic doll at least including arms, legs and feet which are capable of moving in a predetermined aerobic manner. An aerobic video is provided which displays predetermined movements to be performed by such aerobic doll. There is a chip disposed within the aerobic doll. Such chip is connected to the arms, legs and feet for causing predetermined aerobic movements of such aerobic exercise doll. These aerobic movements correspond to the movements of such aerobic video. Finally, there is at least one aerobic type bench for such aerobic exercise doll to perform such predetermined aerobic exercises thereon.

In a second embodiment, the present invention provides an aerobic exercise system for encouraging a person to exercise more, such aerobic exercise system having a doll having movable extremities at least including arms, legs and feet which are capable of moving in a predetermined aerobic manner. An aerobic music means is disposed within such aerobic exercise doll for providing a predetermined beat to which the aerobic exercise doll can exercise. A chip is disposed within the aerobic exercise doll and connected to such arms, legs and feet for causing predetermined aerobic movements of such aerobic exercise doll which correspond to a beat of the aerobic music means. Finally, there is at least one aerobic type bench for such aerobic exercise doll to perform such predetermined aerobic exercises on.

OBJECTS OF THE INVENTION

It is, therefore, one of the primary objects of the present invention to provide a hip hop aerobic exercise system including an aerobic exercise doll which will help promote significantly more exercise by children and adults.

Another object of the present invention is to provide a hip hop aerobic exercise system including an aerobic exercise doll which will significantly reduce medical costs associated with overweight people especially as such overweight people age.

Yet another object of the present invention is to provide a hip hop aerobic exercise system including an aerobic exercise doll which can keep time to a prerecorded video.

Still another object of the present invention is to provide a hip hop aerobic exercise system including an aerobic exercise doll which can mimic the moves of another doll or person doing exercises on such video.

Yet another object of the present invention is to provide a hip hop aerobic exercise system including an aerobic exercise doll will promote better health in the youth of today.

A further object of the present invention is to provide a hip hop aerobic exercise system including an aerobic exercise doll which can be made available with designer clothing.

In addition to the various objects and advantages of the present invention which have been described with some degree of specificity above, it should be recognized that various additional objects and advantages of the present invention will become more readily apparent to those persons who are skilled in the relevant art from the following more detailed description of the invention, particularly, when such description is taken in conjunction with the attached drawing figures and with the appended claims.

Figure 1:
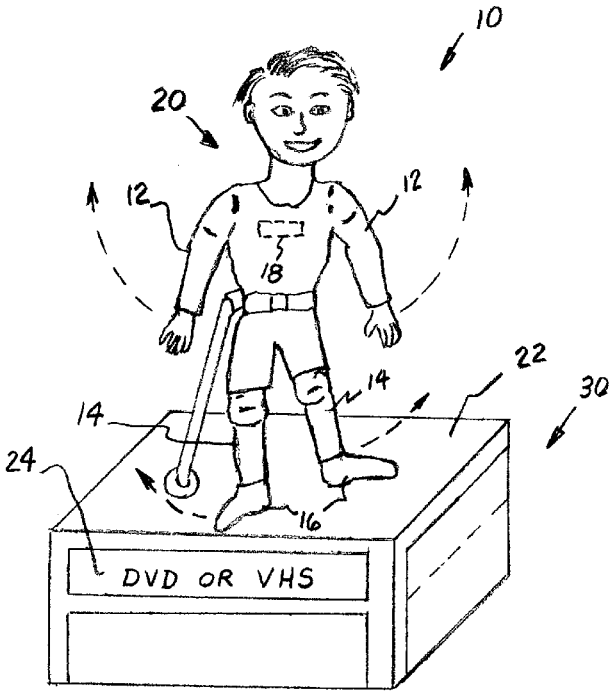
FIG. 1 is a perspective view which illustrates a presently preferred embodiment of a hip hop aerobic exercise system including an aerobic exercise doll.

BRIEF DESCRIPTION OF THE PRESENTLY PREFERRED AND VARIOUS ALTERNATIVE EMBODIMENTS OF THE INVENTION

Prior to proceeding to the more detailed description of the invention, it should be noted that for the sake of clarity and understanding of the invention identical components which have identical functions have been identified with identical reference numerals on each of the views illustrated in the drawings.

Now refer more particularly to FIG. 1. Illustrated therein is a presently preferred embodiment of an aerobic exercise system, generally designated 10, for encouraging a person to exercise more. As shown the aerobic exercise system 10 comprises an aerobic exercise doll, generally designated 20, having movable extremities. These movable extremities at least include arms 12, legs 14 and feet 16 which are capable of moving in a predetermined aerobic manner.

The system further includes an aerobic video means, generally designated 30, for displaying predetermined movements to be performed by such aerobic exercise doll 20. Preferably, such aerobic video means 30 will be recorded on one of a DVD disc or a VHS disc.

Also included in the system is a chip 18 disposed within such aerobic exercise doll 20 and connected to such arms 12, legs 14 and feet 16 for causing predetermined aerobic movements of the aerobic exercise doll 20 which correspond to movements of such aerobic video.

Figure 2:
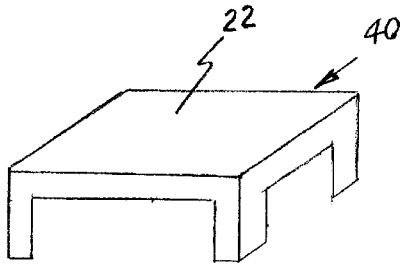
FIG. 2 is a perspective view which illustrates a bench used with the presently preferred embodiment of a hip hop aerobic exercise system.

As best seen in FIG. 2, the aerobic exercise system 10 includes at least one aerobic type bench, generally designated 40, for such aerobic exercise doll 20 to perform such predetermined aerobic exercises on. This aerobic bench may be in the form of a exercise platform 22 for such aerobic exercise doll 20 to perform on. The aerobic exercise platform 22 may include at least one of a DVD and a VHS player 24.

Preferably, the aerobic exercise doll 20 is dressed in designer workout type clothing.

According to an alternative embodiment of the present invention the aerobic exercise system 10 for encouraging a person to exercise more. The aerobic exercise system 10 includes an aerobic exercise doll 20, like the first embodiment, having movable extremities which at least include arms 12 legs 14 and feet 16 which are capable of moving in a predetermined aerobic manner.

In this embodiment the chip 18 also functions as an aerobic music means likewise for providing a predetermined beat to which such aerobic exercise doll 20 can exercise. The chip 18 is disposed within such aerobic exercise doll 20 and is connected to such arms 12 legs 14 and feet 16 for causing predetermined aerobic movements of such aerobic exercise doll 20 which correspond to a beat of such aerobic music means 18.

While in accordance with the patent statutes both a presently preferred and an alternative embodiment have been described in detail it should be understood that various other adaptations and modificatioins can be envisioned by those skilled in the art without departing from the spirit of the invention and the scope of the appended claims.

I claim:

1. An aerobic exercise system for encouraging a person to exercise more, said aerobic exercise system comprising:

(a) a doll having movable extremities at least including arms and legs which are capable of moving in a predetermined aerobic manner;

(b) an aerobic video displaying predetermined movements to be performed by said doll;

(c) a chip disposed within said doll and connected to said arms and legs for causing predetermined aerobic movements of said doll which correspond to movements of said aerobic video;

(d) at least one of an exercise platform for said aerobic doll to perform on and an aerobic type bench for said doll to perform said predetermined aerobic exercises on; and e) at least one of a DVD and a VHS player disposed on said exercise platform.

2. An aerobic exercise system, according to claim 1, wherein said system further includes at least one aerobic type bench for a person to perform aerobic exercises on corresponding to exercises being performed by said aerobic doll.

3. An aerobic exercise system, according to claim 1, wherein said video is one of a DVD and a VHS video.

4. An aerobic exercise system, according to claim 1, wherein said doll is dressed in designer workout type clothing.

* * * * *